US006116178A

United States Patent [19]

McCabe

[11] Patent Number: 6,116,178

[45] Date of Patent: Sep. 12, 2000

[54] SAIL

[76] Inventor: Francis J. McCabe, #6 Bunker Hill Rd., Ottsville, Pa.

[21] Appl. No.: 09/365,012

[22] Filed: Aug. 2, 1999

Related U.S. Application Data

[63] Continuation-in-part of application No. 09/181,113, Oct. 28, 1998, Pat. No. 5,937,778.

[51] Int. Cl.[7] ..... B63H 9/04

[52] U.S. Cl. ..... 114/102.13; 416/237

[58] Field of Search ..... 114/102.1, 102.13, 114/102.14, 102.22, 39.1, 39.21, 39.3, 39.31; 416/237

[56] References Cited

U.S. PATENT DOCUMENTS

| | | | |
|---|---|---|---|
| 3,934,533 | 1/1976 | Wainwright | 114/102.22 |
| 4,402,277 | 9/1983 | Wainwright | 114/102.22 |
| 4,655,122 | 4/1987 | McCabe | 98/119 |
| 5,599,172 | 2/1997 | McCabe | 417/334 |
| 5,711,653 | 1/1998 | McCabe | 416/237 |

*Primary Examiner*—Jesus D. Sotelo
*Attorney, Agent, or Firm*—Frank J. Benasutti

[57] ABSTRACT

A sail has a main sheet mounted to a mast; a leading vane on the other side of said mast from said main sheet and pivotally connected thereto; a trailing vane attached to the longitudinal edge of said main sheet remote from said mast; and an angled dual-lip member pivotally attached to the trailing edge of said trailing vane and wind spill plates to capture the air in the envelope of the sail.

10 Claims, 6 Drawing Sheets

SAIL

CROSS-REFERENCE TO RELATED APPLICATION

This application is a continuation-in-part of my prior application Ser. No. 09/181,113, filed Oct. 28, 1998, now U.S. Pat. No. 5,937,778 for a SAIL; the disclosure of which is incorporated herein by reference as if fully set forth.

TECHNICAL FIELD

This invention relates to improvements in sails for sail boats, and more particularly, to the aerodynamic shape of a sail having improved characteristics; and associated devices.

BACKGROUND ART

In the prior art, a wide variety of shapes have been used to harness the power of air in sails for vessels. Further, it has been suggested to use airfoils mounted vertically as the sail means.

In my prior art U.S. Pat. No. 4,655,122, I disclosed an improved aerodynamic shape which comprised essentially a planar face portion and leading and trailing edge portions associated with opposite ends of the face portion to form a pan-shaped enclosure. These shapes were used as blades in an air damper; where one or more blades were pivoted for rotation within a frame. In that environment, the blades provided an increased lift when forced to open by air escaping from a structure.

In my work with windmills, I experimented with various shaped blades, such as that disclosed in my U.S. Pat. No. 5,599,172 for a wind energy conversion system; which had an additional lip on the trailing edge.

In my U.S. Pat. No. 5,711,653, I disclosed an airfoil design with a 90° flange depending from the trailing edge. This displayed improved lift characteristics.

Sails, however, develop their own unique problems unrelated to environments where airfoils are normally used; such as, in particular, the fact that the sails flop back and forth from port to starboard and back again, depending on the direction of the wind. Thus, each side of the sail is acted upon in a different manner rather than being constantly impinged upon in a uniform manner.

DISCLOSURE OF THE INVENTION

SUMMARY OF THE INVENTION

I have invented a new sail which, in its simplest form, comprises a main sheet, a leading portion, a trailing portion, and a dual-flanged portion extending from the trailing portion, which dual-flange portion is preferably pivoted thereto, so as to flip back and forth from port to starboard and starboard to port side; most preferably, automatically.

I also provide associated devices to optimize the performance of my new sail.

DESCRIPTION OF THE PREFERRED EMBODIMENTS

Figure 1:
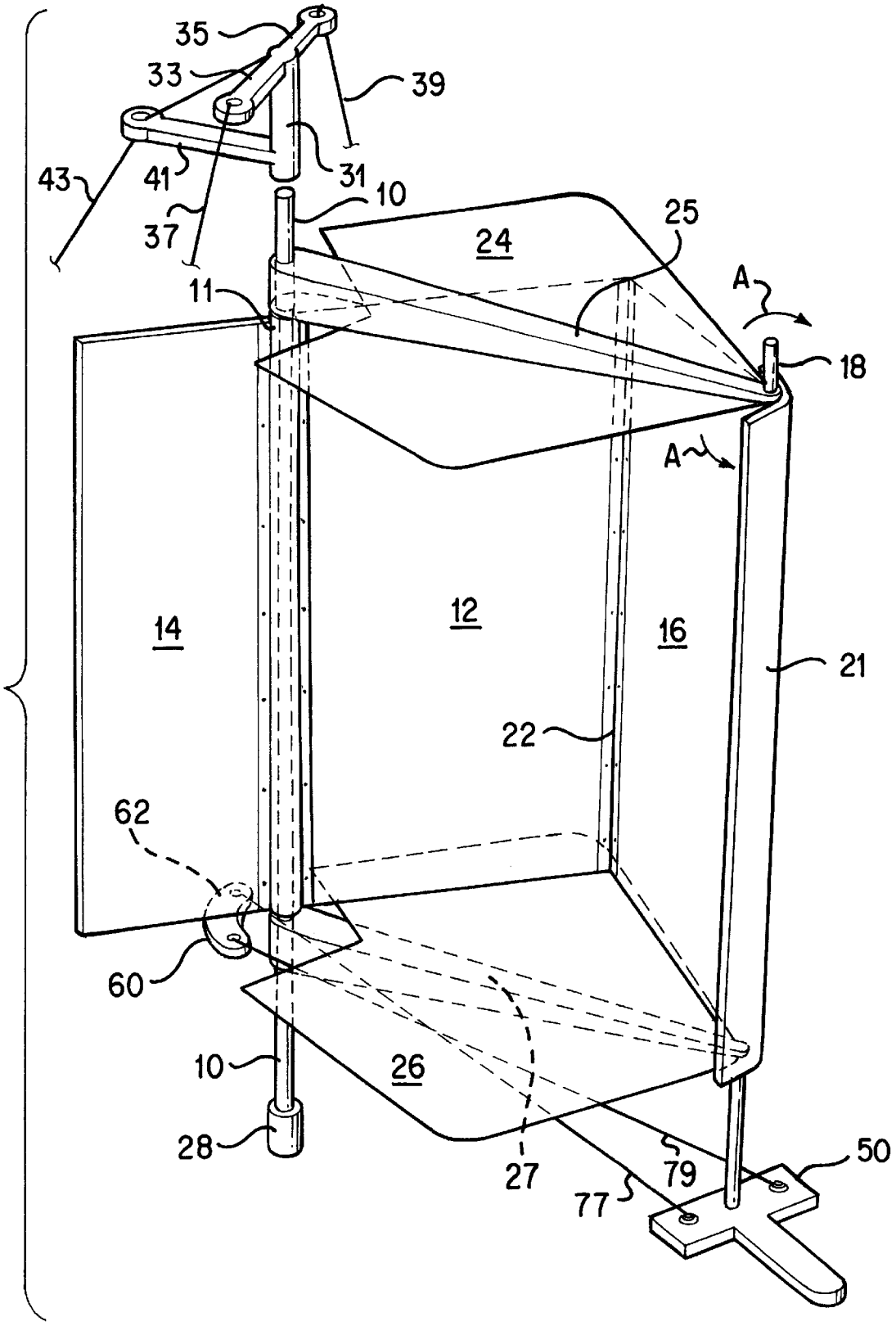
FIG. 1 is an exploded perspective view of a sail in accordance with the preferred embodiment of my invention.

FIG. 1 shows a sail for use in a sailboat (conventional per se and shown diagrammatical in FIG. 7) having a mast 10 and a main sheet 12 which, in this embodiment, is made most preferably of aluminum 0.020 inches thick, attached by any suitable means to a support sleeve 11 embracing the mast. A leading vane 14 is provided attached to the support sleeve 11 by a hinging means; and is most preferably made of aluminum or a composite material or a fabric.

A trailing vane 16 is provided attached to the main sheet 12 and is most preferably made of a fabric.

Figure 1A:
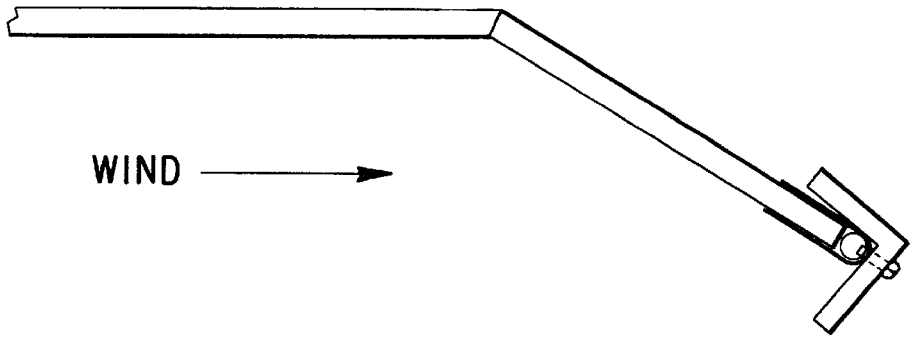
FIG. 1A is a top view of a portion of the apparatus shown in FIG. 1.
Figure 1B:
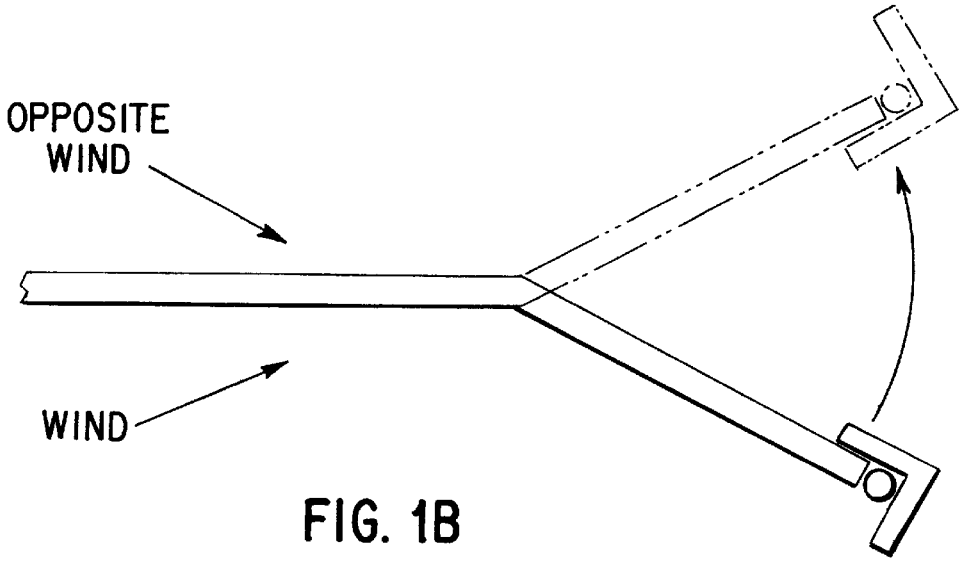
FIG. 1B is a top view similar to FIG. 1A showing a portion of the apparatus in an alternate position and a phantom portion in an alternate position.
Figure 1C:
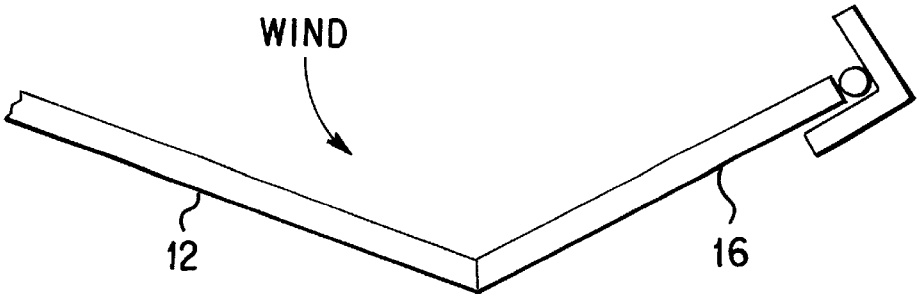
FIG. 1C is a view similar to FIG. 1B with a portion in an alternate position.

The cloth material which forms the trailing edge vane section 16 can, and in fact does, flex to allow a back and forth movement of the main sheet 12 to a certain degree as one side or the other of the sail fills with air. See FIGS. 1A, 1B and 1C.

The trailing vane 16 has a rigid angled dual-lip 21 fixedly mounted to it through a rod 18 and the fabric of which the vane 16 is made.

In the preferred embodiment, there is no control over the movement of the pivoted angled dual-lip, in that the wind itself will flip this angle, i.e., back and forth as indicated by the arrows A,A in FIG. 1. Accordingly, if the wind is on the foremost side shown in FIG. 1, the angled lip would automatically be flipped outwardly to the position shown in FIG. 1A, when viewed from above. If this was to occur, the sail members 12 and 16 would be in the position shown in FIG. 1; until such time as the wind shifted so as to impinge on the other side, in which case they would flip through or invert so as to come between the mast 10 and the rod 18 and into the foreground when viewed as in FIG. 1 or the positions shown in FIGS. 1B and 1C when viewed from above. Thus, if the wind was on the other side of the sail, then the angled lip 21 would be flipped to the position shown in FIGS. 1B and 1C. Note that in 1C the main sheet 12 and trailing edge vane 16 have re-oriented themselves.

The trailing edge angled lip 21 is connected to the vane 16 as aforesaid most preferably by means of a ½ inch rod 18 that rotates in the bar 50. This rod extends beyond the bottom portion of the lip 21 as shown in FIG. 1.

The 18 rod upon which the angled lip 21 is mounted for rotation extends downwardly and is journaled in the cross portion of the T-shaped tiller bar 50; so that the tiller bar is retained axially thereon, but it can rotate thereabout.

Figure 3:
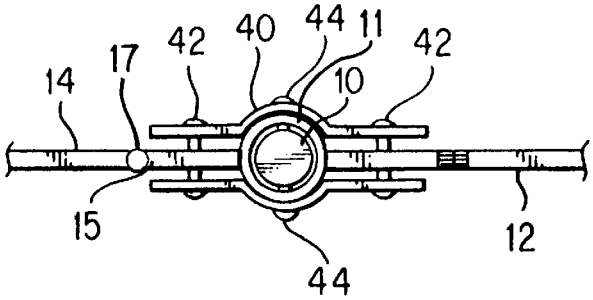
FIG. 3 is a top view of a portion of the sail shown in FIG. 1.
Figure 4A:
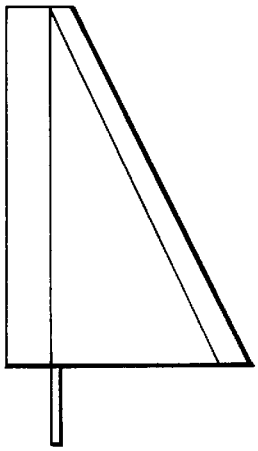
FIGS. 4A, 4B, and 4C show diagrammatic view of a sail having different configuration.
Figure 4B:
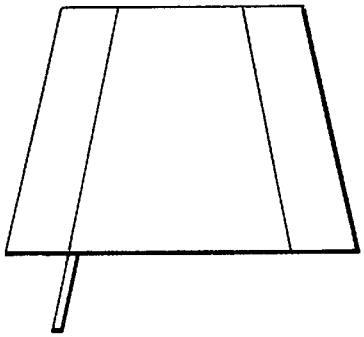
Figure 4C:
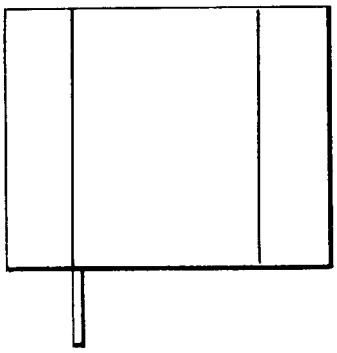

The hinging means by which the leading vane 14 and main sheet 12 are connected at the mast 10 are shown in end view in greater detail in FIG. 3. Therein, it will be noted that pieces of sheating 40 are placed around the support sleeve 11 which embraces mast on both sides and riveted thereto as at 44 and to leading vane 14 on one side and the main sheet 12 on the other side as by means of rivets 42. The stiff material forming the leading edge 14 may be hinged as at 17 to a support 15.

Most preferably, the device is controlled by a tiller bar 50, FIG. 1. The tiller bar is T-shaped. On opposite ends of the cross portion of the "T", cords 77, 79 are connected to the leading vane 14 to control its position. This connection is made to the members 60 and 62 which are fixedly attached to the lower edge of the member 14 by any suitable means. The members 60 and 62 have holes therein as clearly shown for tying off the cords 70 and 72. These cords are crossed on their way back toward the tiller bar 50 as clearly shown in FIG. 1; so that when the sail is placed at an angle to the wind and the wind blows, it automatically reverses the sails and vane 14 and provides that the sail acts as an air foil by holding the end of the tiller bar 50.

Most preferably, at top and bottom edges of the main sheet 12 and vane 16, I provide wind spill containment plates or air deflectors as shown at 24, 26, respectively. These are fixedly mounted to the support sleeve 11 by means of the cantilevered structural members 25 and 27, respectively, but are not fixedly attached to the members 14 or 16. Rather, they are in close proximity to the sail's longitudinal edges. These are needed on this type airfoil and even more important on sail boats that would severely list the sail top away from the wind—causing deflection of the air flow towards and over the top of the sail instead of over the trailing edge.

The reason for the shape of the members 25 and 27 is that they follow and just exceed the envelope defined by the expected travel of the outermost positions that the sail members 12 and 16 can assume. I have found that these auxiliary devices, or air shields, actually help capture the air and make the sail more efficient.

The mast 10 is journaled for rotation in the bearing means or swivel base 28 which is fixedly attached to the boat deck. Disposed in a portion of the space between the mast 10 and the support sleeve 11 is a long cylindrical bushing 31 shown in the exploded perspective diagrammatic view FIG. 1. At the upper end of this bushing are rods 33 and 35 which are fixedly attached thereto and have holes thereon at their outer tips to accommodate being tied off to guide wires 37, 39. Also fixedly attached to the bushing 31 is a rod 41 which extends preferably perpendicular to the rods 33, 35, and also has a hole at its outer tip to support guide wire 43. Those guide wires 37, 39 and 43 are attached to the structure of the boat and maintain the position of the mast 10 and support sleeve 11 in conjunction with the mounting member 28.

Figure 2:
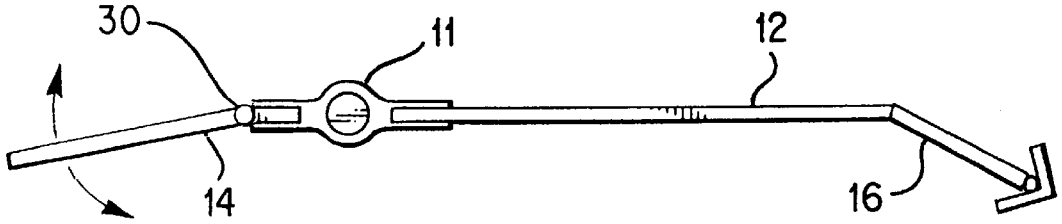
FIG. 2 is a top view of an alternate embodiment of my invention.

The embodiment shown in FIG. 2 shows a top view of FIG. 1 in which the lead vane 14 is pivotally attached at 30 to the mast sheathing 11. This is a combination relative wind alignment vane and leading airfoil section (vane 14); which may be set up to either automatically or manually control the wind coming into the leading edge vane 14 and shaping the overall sail configuration for air lift control.

Figure 5:
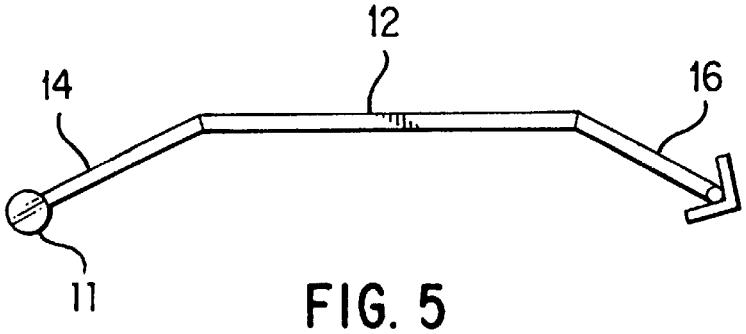
FIG. 5 is a top view of an alternative embodiment of a sail.
Figure 6:
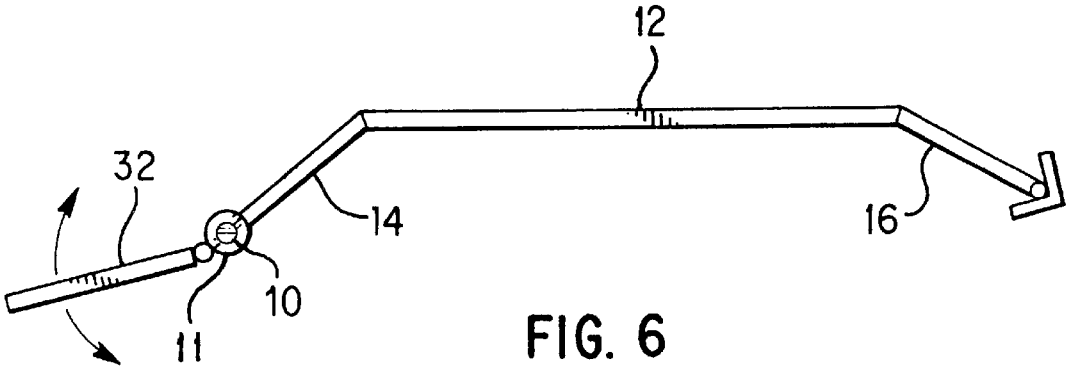
FIG. 6 is a top view of another alternative embodiment of a sail.

Other alterative embodiments are shown in FIGS. 5 and 6. In FIG. 5, the sail is attached to the mast at the outermost edge of the leading vane 14.

In FIG. 6, a modification of the sail arrangement, as shown in FIG. 5, is shown comprising a further vane 32 pivotally attached to the mast to serve as a separate, relative wind alignment vane.

Figure 7:
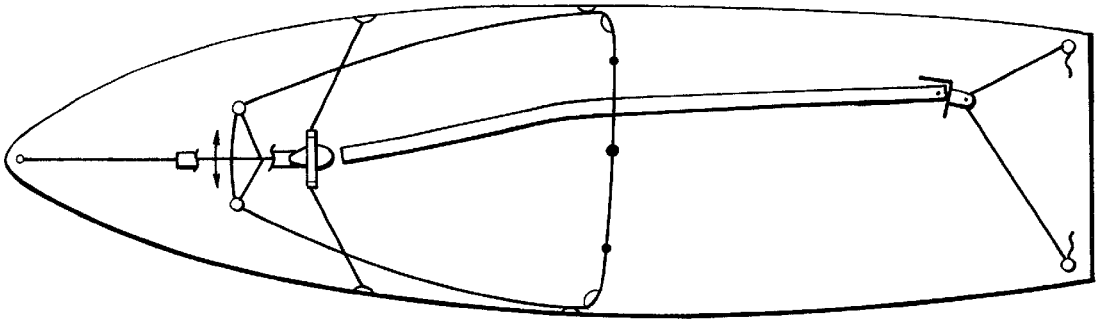
FIG. 7 is a diagrammatic top plan view of a sailboat outfitted with my new sail.

FIG. 7 shows a top diagrammatic view of a sail arrangement in accordance with my invention rigged as indicated.

Figure 8:
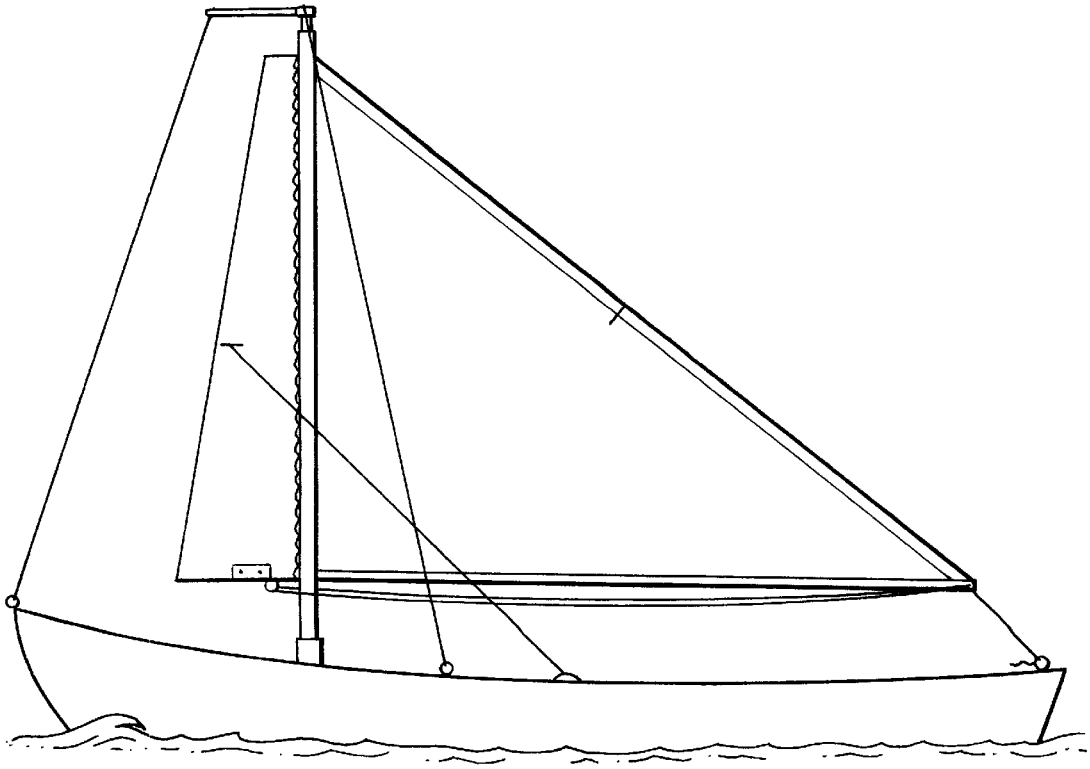
FIG. 8 is a diagrammatic side view of a sailboat with a sail in a triangular configuration.
Figure 8A:
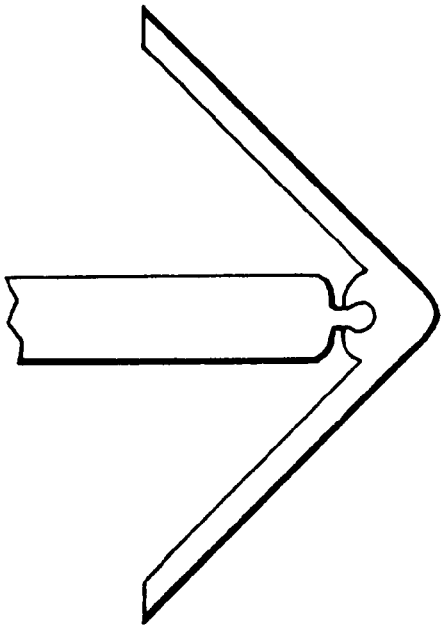
FIGS. 8A and 8B show different arrangements for connecting the angle lip to vane.
Figure 8B:
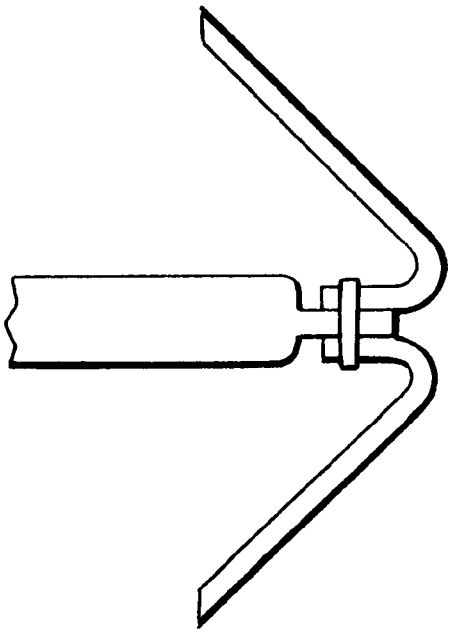

FIG. 8 is a side view of a sail in accordance with my invention, but in this case, the sail is triangular in shape and the angled lip is fastened along the hypotenuse of the triangular shaped sail. The triangular shaped sail eliminates the need for wind spill containment.

What is claimed is:

1. In a sail comprising a main sheet mounted to a mast; a leading vane on the other side of said mast from said main sheet and pivotally connected thereto; a trailing vane attached to the longitudinal edge of said main sheet remote from said mast; and an angled dual-lip member pivotally attached to the trailing edge of said trailing vane; the improvement comprising: wind spill containment plate means comprising at least one wind spill containment plate extending generally from the mast along at least one longitudinally extending edge of said main sheet in close proximity thereto to aid in retaining the air within the envelope defined by the movement of the sail.

2. A sail as in claim 1 wherein a plurality of said plates are positioned above and below the sail and the outer peripheries of said plates extend substantially to the full extent of the envelope defined by the maximum movement of the sail.

3. The sail of claim 1 wherein structural members are cantilevered from the mast to support said plate means.

4. The sail of claim 3 wherein a rod is attached to the angled dual lip member and is attached to the support cantilevered structural members.

5. The sail of claim 1 wherein the main sheet composed of a flexible yet substantially rigid material, and the trailing vane is constructed of a flexible fabric material.

6. The invention of claim 1 wherein an additional relative wind alignment means is provided comprising an additional vane attached to the edge of the leading vane most remote from its connection with the mast, for pivotal movement with respect thereto.

7. The sail of claim 1 wherein the overall shape of the sail is triangular.

8. The sail of claim 1 wherein the overall shape of the sail is trapezoidal.

9. The sail of claim 1 wherein the overall shape of the sail is rectangular.

10. The sail of claim 1 wherein a sail and vane control bar means is provided connected to a leading vane for manually controlling the movement thereof.

* * * * *